United States Patent [19]

McCrainor et al.

[11] Patent Number: 4,824,438

[45] Date of Patent: Apr. 25, 1989

[54] PROCESS FOR PRODUCING SMOKELESS, CURED FUEL BRIQUETTES

[75] Inventors: Peter R. McCrainor, Solihull, England; Peter B. Caplin, Johannesburg, South Africa; James W. Middlemas, Leatherland, England; Geraint Rees, Dyfed, Wales; Mario Angelini, Bruxelles, Belgium

[73] Assignee: Petrofina, U.K. Ltd., England

[21] Appl. No.: 149,287

[22] Filed: Jan. 28, 1988

[30] Foreign Application Priority Data

Jan. 28, 1987 [GB] United Kingdom ..... 8701866

[51] Int. Cl.[4] ..... C10L 5/20; C10L 5/06

[52] U.S. Cl. ..... 44/16 F; 44/593; 44/598

[58] Field of Search ..... 44/16 F, 598, 593, 625

[56] References Cited

U.S. PATENT DOCUMENTS

| | | | |
|---|---|---|---|
| 1,596,239 | 8/1926 | Delzeit | 44/16 F |
| 3,684,465 | 8/1972 | Hsu | 44/16 F |
| 4,238,200 | 12/1980 | Richter | 44/16 F |
| 4,294,584 | 10/1981 | Verschuur | 44/598 |
| 4,618,347 | 10/1986 | Watt et al. | 44/16 F |

FOREIGN PATENT DOCUMENTS

| | | |
|---|---|---|
| 1047584 | 12/1953 | France . |
| 63415 | 9/1955 | France . |
| 1498494 | 1/1978 | United Kingdom . |
| 2040308 | 8/1980 | United Kingdom . |

OTHER PUBLICATIONS

British Standards 3841 British Standards Institute 1016, Part 13.

*Primary Examiner*—Carl F. Dees

*Attorney, Agent, or Firm*—Mark A. Montgomery; John K. Abokhair; M. Norwood Cheairs

[57] ABSTRACT

Green briquettes made from particulate carbonaceous material and lignosulfonate as a binder are cured in an oven in the presence of circulating gases containing a high percentage of oxygen and superheated steam. The sulfur derived from the binder is oxidized and then hydrolyzed (exothermic reactions) at the curing temperature with formation of sulfuric acid, which is dissociated (endothermic reaction) in the case of a temperature rise. The reactions provide a means for thermal balance within the curing oven.

20 Claims, No Drawings

PROCESS FOR PRODUCING SMOKELESS, CURED FUEL BRIQUETTES

BACKGROUND OF THE INVENTION

This invention relates to a process for producing smokeless, cured fuel briquettes from particles of combustible solid carbonaceous material, in particular coal particles, such as coal fines, anthracite duff, etc.

Many briquetting methods are known that agglomerate particulate carbonaceous materials using bonding agents in briquetting machines. However, the agglomerates thus obtained, called "green briquettes", often require a curing treatment in order to improve their physical and/or chemical characteristics. In addition, these green briquettes often require a desmoking treatment in order to reduce the evolution of smoke during their combustion. Smokeless briquettes are defined hereinafter according to British Standard 3841.

Current agglomeration technology for producing coal briquettes is generally based upon the use of three principal binders, either separately or together, although many other binders are known in the art. These three binders are bitumen derived from the refining of crude oil; coal tar pitch; and ammonium lignosulfonate or sulfite waste liquor which is a by-product from the paper industry. The use of bitumen or coal tar pitch as a binder is a well-established process practiced by several manufacturers and is generally associated with an oven cure technique in which the green briquettes are desmoked at medium temperatures in an oxidizing atmosphere.

The use of ammonium lignosulfonate as a binder for carbonaceous briquettes used in the smokeless fuel market is not as widely used as bitumen or coal tar pitch. However, processes are known in the art that use ammonium lignosulfonate as a binder. These processes generally incorporate an oven cure technique in the presence of an oxygen containing atmosphere in which the oxygen content approaches the oxidizing stoichiometric amount or near reducing conditions. This limitation of oxygen content was necessary when using this binder because there was a need to control or limit the possibility of rapid oxidation and exothermic reactions. If the oxygen content was not limited, the rapid oxidation and exothermic reactions would lead to uncontrollable combustion of the briquettes during treatment and consequent loss and damage to product and plant. However, this necessary limitation of oxygen content during the curing treatment of agglomerates leads to several drawbacks, the major drawback being the production of undesirable gases. When working under a near reducing atmosphere, the sulfur of the lignosulfonate is transformed into mercaptans, hydrogen sulfide and other noxious and toxic compounds that present a pollution problem. Moreover, the curing rate is too low and the cured briquettes have a poor physical strength.

OBJECTS OF THE INVENTION

It is an object of the present invention to prepare improved cured briquettes from particulate carbonaceous material and lignosulfonate binder. It is a more specific object of the present invention to prepare cured coal briquettes using lignosulfonate binder that exhibit the physical and combustion characteristics of high quality products. It is also an object of the present invention to provide a process for producing briquettes characterized by a high calorific value. It is a further object of the present invention to provide a process for preparing briquettes using lignosulfonate binder that avoids the formation of noxious products during the curing treatment.

SUMMARY OF THE INVENTION

The process according to the present invention for producing cured fuel briquettes comprises forming green briquettes from particulate carbonaceous material and lignosulfonate as a binder, followed by curing the green briquettes in an oven in the presence of circulating gasses containing a high percentage of oxygen and superheated steam. The sulfur derived from the lignosulfonate binder is oxidized and hydrolyzed exothermally in the oven at the curing temperature with the formation of sulfuric acid which is dissociated endothermally in the case of a temperature rise. The endothermic dissociation of the sulfuric acid provides a means for thermal balance within the curing zone, and any remaining small excess amount of heat is removed in the circulating gases.

DETAILED DESCRIPTION

According to a preferred process of the present invention green briquettes are formed from particulate carbonaceous material and a lignosulfonate binder and are then cured in an oven in the presence of circulating gases having a high oxygen content in conjunction with superheated steam, wherein the briquette internal temperature is between about 210° C. to 335° C.

According to one embodiment of the present invention, the circulating gases and the superheated steam are produced by treatment of the off gases from the curing oven in a fluidized bed combustion unit.

It has been unexpectedly found that the curing of fuel briquettes produced with lignosulfonate as a binder can be achieved utilizing a high oxygen atmosphere during the cure in a medium temperature oven, without the risk of uncontrolled oxidation and resultant fire damage. The curing of the fuel briquettes according to the present invention is a definite advantage since the noxious gaseous by-products are eliminated. Moreover, the cured briquettes exhibit improved characteristics related to water resistance, physical strength and combustion.

Agglomeration of particulate carbonaceous material, such as coal, more particularly anthracite fines, anthracite duff, or similar carbonaceous material is performed by using a lignosulfonate as a binder, more particularly ammonium lignosulfonate. Lignosulfonate is a by-product of the sulfite process for producing pulp in the wood industry by the reaction of bisulfite on wood. The quality of the lignosulfonate depends upon the source of lignin, the process conditions, and the resulting molecular weight distribution and average value.

According to the present invention, the ammonium lignosulfonate is usually applied to the coal fines as a dispersion in water; preferably as a 50% by weight dispersion in water. Generally the coal briquettes are manufactured by using between 4 to 10 wt.% ammonium lignosulfonate based on the weight of coal fines.

It is known in the art that the amount of water in the resulting binder/coal fines mixture should not be excessive when pressing the briquettes. In the preferred embodiment, coal and binder are intimately mixed, any excess water is eliminated and the mixture is pressed at a temperature between the range of about 40° C. to 100° C., preferably about 60° C. to 85° C.

The green briquettes obtained from the pressing step are then subjected to a curing treatment. According to this invention, the green briquettes are cured in the presence of circulating gases having a high oxygen content in conjunction with superheated steam. The briquettes cured according to this process exhibit improved briquette characteristics relating to water resistance, physical strength and combustion. The curing atmosphere of the present invention promotes oxidation of the sulfur from the lignosulfonate binder with formation of sulfur oxides, mainly $SO_3$.

In the preferred embodiment of the present invention, the off gases from the curing treatment are introduced into a fluidized bed combustion unit. Preferably, the hot gas generator of this fluidized bed combustion unit is coal fired and has an operating temperature of about 850° C.

Any suitable means for removing the sulfur oxides can be employed in the combustion unit of the present invention. For example, finely divided substances which absorb sulfur-derivatives can be added to the coal in the fluidized bed unit. These additives e.g. quicklime, or ground limestone, react not only with the $SO_2$ produced by coal combustion, but also with the $SO_3$ carried by the curing zone off gases through the fluidized bed. The reaction of the additives with the $SO_2$ and $SO_3$ produces calcium sulfate and calcium sulfite which can be removed from the bed. Consequently, the process of the present invention permits a substantial reduction in the amount of sulfur oxides that are exhausted from the plant chimney.

Another feature of the preferred process of the present invention is the production of superheated steam in the fluidized bed unit. The moisture or steam, for the superheated steam, is released from the heated green briquettes which are supplied continuously to the curing oven.

In carrying out the process of the preferred embodiment of this invention, the off gases, emanating from the curing oven are circulated to the coal-fired fluidized bed unit which results in the production of hot gases and superheated steam. These hot gases and superheated steam are returned to the curing oven along with the addition of excess air. The oven atmosphere is generally maintained at not less than 14 vol.% oxygen, preferably not less than 17 vol.% oxygen. Such a high oxygen atmosphere associated with the reactive oven cure temperature promotes the oxidation of sulfur derived from the lignosulfonate binder, to produce $SO_3$. This oxidation reaction in the curing oven is believed to be catalyzed. The $SO_3$ is finally hydrolyzed by the superheated steam. Hydrolysis, as used herein, represents the reaction of $SO_3$ with superheated steam to produce sulfuric acid. This hydrolysis reaction is exothermic and the curing reaction then does not depend totally upon heat transfer from the circulating hot gases.

A substantial technical advantage of the process of the present invention is that the sulfur derived from the lignosulfonate binder is oxidized to $SO_3$, while in the prior known processes that use a near reducing atmosphere hydrogen sulfide, mercaptans, carbonyl sulfide and other noxious compounds are produced.

In a preferred embodiment of the present invention, the sulfur oxides are removed from the final exhaust by means of wet gas scrubbing accompanied by the addition of neutralizing agents, e.g. sodium hydroxide, calcium oxide, sodium carbonate.

A further technical advantage of the process of the present invention is that a thermal equilibrium is established in the curing oven. Although not wishing to be bound by theories, it seems that this equilibrium results from exothermic and endothermic reactions. The oxidation of sulfur from the briquette binder takes place at a temperature between 210° C. to 240° C. The $SO_3$ produced is then hydrolyzed by the superheated steam with formation of $H_2SO_4$, at temperatures between 210° C. to 290° C. These two exothermic reactions promote the curing reaction within the bed. At temperatures higher than a threshold value of 290° C., an endothermic dissociation of $H_2SO_4$ occurs providing a controllable thermal balance when operating in a temperature range between 290° C. to 335° C.

By taking advantage of this temperature-controlled exothermic hydrolysis of $SO_3$ and endothermic dissociation of $H_2SO_4$, an essential exotherm can be established at a temperature less than 290° C. during most of the cure time, in fact 75% of the cure time. During the final cure period, the temperature is allowed to rise above 290° C. but yet not above 335° C. At this temperature range, the exotherm and endotherm are approximately balanced to prevent severe temperature rise and consequent fire risk. During this final period, the higher temperature ensures a maximum oxidation of the sulfur remaining in the briquettes. This results in a strong carbon matrix, bonding the fine material of the briquettes, producing high strength briquettes of high water resistance.

Since nitrogen is the major component in the air supply, excess air, while affecting the total oxidizing atmosphere in the curing oven, also provides a very substantial and effective heat carrier. Moreover, any accidental increase in temperature during the curing period can be controlled by varying the air flow. The variable addition of air to the curing oven will provide a means to remove heat from the briquette bed but yet will not substantially effect the rate of oxidation, since the oxygen in the oven atmosphere is generally maintained at not less than 14%, preferably not less than 17%, but not more than 20%.

The following examples are given in order to illustrate the present invention, but are not intended to limit the reasonable scope thereof.

EXAMPLE 1

Anthracite duff was dried to reduce its moisture content down to about 2% to 4% and was passed through a milling and screening stage to obtain a varying size grading that did not exceed 3 mm maximum particle size.

The dried material was conveyed from the drier at a temperature between 85° C. and 100° C. The ammonium lignosulfonate binder, as a 50% dispersion in water, was injected under superheated steam to converge with a falling curtain of the graded anthracite. The amount of binder was 5% based on the weight of anthracite. The mixture was then passed to a steam heated mechanical agitator to complete the mixing and to partially dewater the mixture in the transportation screw to the press.

The water content of the mixture entering the mixing device was 10% by weight, being composed of 4% water carried by the dried anthracite plus 6% water from the binder dispersion. Sensible heat from the hot anthracite, supplemented by sensible heat from the superheated steam injected into the mixer, was sufficient to remove the excess water, such that the water content of the thoroughly mixed material, passing to the press, did not exceed 8% by weight.

After pressing, the residual sulfur in the uncured briquettes was 1.3%.

The oven cure was achieved in three stages, divided into zones for control purpose.

The first stage was the preheat where the green briquettes were heated to evaporate the contained moisture after pressing, and to elevate the briquette temperature to the reaction temperature for oxidation of the binder. Preheat raised the temperaure of green briquettes from 65° C. to 210° C. The stage was divided into three coupled zones, and these received hot gas progressively at temperatures ranging from about 130° C. in the first zone through 170° C. to about 210° C. in the third zone. The off gas from these zones, at approximately 130° C., was passed to the precooler stage or zone, which is the third process stage.

The second stage or curing stage was divided into four zones, which were controlled by hot gas addition according to a temperature profile typically ranging from about 250° C., 260° C., 250° C., to 240° C. Supplementary air was also added at the same time as the hot gas, to maintain the oxygen content at no less than 17% in all the curing zones, and to control the briquette temperatures progressively. Typically the briquette temperatures were about 220° C., 250° C., 275° C., and 300° C. During the final two zones of the curing stage, supplementary air was injected to give an amount of air greater than the amount required to keep an oxygen content of at least 17%. Due to the exotherm obtained in these zones, supplementary air was needed to cool the briquette bed by removing sensible heat.

The hot gas source, for preheat and curing zones, was available at temperatures ranging from 800° C. to 950° C., and was passed into the oven zones to mix with the gas in closed circulation to provide the zone input gas temperature as stated.

The curing zones mixed off gas, passing to a common manifold, were at a temperature of 230° C.

The third, precooler stage, which received the off gas from the preheat stage at about 130° C., exhausted off gas to the common off gas manifold at a temperature varying between 230° C. and 260° C.

The briquette temperature leaving the third stage, or precooler, was reduced from a final cure temperature of 300° C., down to a temperature varying between 240° C. and 260° C.

The briquettes were then cooled to 100° C., by passing through the air blast cooling stage, before continuing to the distribution conveying plant.

The properties of the treated briquettes measured one week after curing are indicated in the following table. The shatter test (resistance to dropping) and the drum test (resistance to abrasion) were carried out according to British Standard 1016, Part 13. The crushing strength measurements were conducted by placing a pillow-shaped briquette between a static plate and a parallel mobile plate, the direction of the compression force being perpendicular to the plates.

TABLE

| | | |
|---|---|---|
| Weight, g | 40 | |
| Volume, ml | 34 | |
| Apparent density, g/ml | 1.17 | |
| Water content, wt. % | 2.8 | |
| Average crushing strength, kg | 165 | |
| Standard deviation (30 briquettes) kg | 27.2 | |
| Resistance to dropping | % below | Surviving briqs |
| % passing 5 mm sieve after | 5 mm | ie 75% intact |
| 1 × 6 ft. (1.8 m) | 1.5 | 83.5 |
| 2 × 6 ft. (1.8 m) | 2.1 | 68.6 |
| 3 × 6 ft. (1.8 m) | 2.4 | 60.5 |
| 4 × 6 ft. (1.8 m) | 3.0 | 53.1 |
| Resistance to abrasion after revolutions | 25 revs | 50 revs |
| % passing 5 mm sieve | 8.7% | 17.2% |
| Tar content, volatiles (wt. %) | 9.5 (B.S. 106 Part 3) | |
| sulfur content, wt. % | 1.1 | |
| Bulk density | 43 lb/ft$^3$ | 690 kg/m$^3$ |

The dilution or supplementary air supplied to the curing oven was separately fan-forced, and controlled by individual valves associated with each zone of the oven in the cure section. This fact relates to the last of the preheat zones in addition to the four curing zones.

The off gases which were recycled via a fluidized bed combustion unit were fan forced to the fluidized bed at a temperature of 240° C. These gases were further supplemented by combustion air separately fan-forced in the fluidized bed combustion unit, where further heat release is obtained from direct coal feed to the combustion unit.

Accordingly, the curing process entailed treating the off gases from the curing oven in a fluidized bed combustion unit and then recycling to the curing oven the gases which contain a substantial proportion of the superheated steam at more than 12% by weight, but not more than 20% by weight. After addition of dilution air to these circulating gases, a highly oxidizing atmosphere was present in the curing oven. This atmosphere promoted the oxidation of sulfur contained in the lignosulfonate binder into $SO_3$ and the hydrolysis of $SO_3$ to $H_2SO_4$. These exothermic reactions combined with the endothermic dissociation of $H_2SO_4$ permit the control of the curing temperature.

EXAMPLE 2

Washed anthracite duff was dried to reduce its moisture content to less than 1% and was then passed through a crusher to obtain a varying particle size grading that did not exceed 3 mm.

The dried crushed material was conveyed to a mixer, reaching it at a temperature of about 115° C. The ammonium lignosulfonate binder, as a 50% dispersion in water, was injected under pressure at a temperature of about 70° C. The amount of binder emulsion was 13%, based on the total weight of the mixture.

The mixture was then passed through an evaporation device where the sensible heat from the hot anthracite was used to remove the excess water, such that the water content of the thoroughly mixed material passing to the press did not exceed 5.5% by weight.

The green briquettes were conveyed at a temperature of about 75° C. to a three stage curing oven divided into eight zones for control purposes.

The first stage was the preheat where the green briquettes were heated to evaporate the contained moisture after pressing, and to elevate the briquette temperature to the temperature for oxidation of the binder. Preheat raised the temperature of green briquettes from 75° C. to 210° C. The stage was divided into three zones receiving hot gas progressively at average temperatures from about 130° C. in the first zone to about 210° C. in the third zone. The off gas from the two first zones, at approximately 130° C., was passed to the precooler stage or zone eight, which is the third process stage.

The second stage or curing stage was divided into four zones, which were controlled by hot gas addition according to an average gas temperature profile typically ranging from 230° C., 250° C. to 240° C. Supplementary air was also added, at the same time as the hot gas, to maintain the oxygen content around 18% in all the curing zones. In the two middle zones of the curing stage, supplementary air was injected to give an amount of air greater than the amount required to keep an oxygen content of at least 17%. Due to the exotherm obtained in these zones, supplementary air was needed to cool briquette bed by removing sensible heat.

The hot gas source, for preheat and curing zones was available at a temperature ranging from 750° C. to 850° C. and was passed into the oven zones to mix with the gas in closed circulation to provide the zone input gas temperature as stated.

The curing zones mixed off gas, passing to a common manifold, was at a temperature of about 230° C.

The third, precooler stage, which received the off gas from the preheat stage at 130° C. exhausted off gas to the common off gas manifold at a temperature varying between 230° C. and 260° C.

The briquettes were then cooled to 100° C. by passing through the air blast cooling stage, before continuing to the distribution conveying plant.

The properties of the treated briquettes measured a few weeks after curing and outdoor storage are indicated below:.

| | | |
|---|---|---|
| Mean briquette mass: | 42 | gr as received |
| | 39.3 | gr dry basis |
| Bulk density: | 694 | $kg/m^3$ as received |
| | 648 | $kg/m^3$ dry basis |
| Average crushing strength: | 177.8 | kg |
| Standard deviation (20 briquettes): | 27.2 | kg |
| Ash: | 5.3 | wt. % (dry basis) |
| Volatile: | 9.5 | wt. % (dry basis) |
| Sulfur: | 1.21 | wt. % (dry basis) |

Drum Test (resistance to abrasion) (% cumulative) (B.S. 1016, Part 13)

| | 25 revs | 50 revs |
|---|---|---|
| +30 mm | 79.5 | 56.8 |
| +25 mm | 84.7 | 65.1 |
| +20 mm | 86.7 | 73.0 |
| +15 mm | 90.0 | 77.8 |
| +10 mm | 91.8 | 82.1 |
| +5 mm | 93.8 | 85.3 |
| −5 mm | 6.4 | 14.7 |

Shatter Test (resistance to dropping) (% cumulative) (B.S. 1016, Part 13)

| | Survival (+40 mm) | Medium debris | −5 mm debris |
|---|---|---|---|
| Drop 1 | 84.7 | 14.4 | 0.9 |
| Drop 2 | 77.5 | 21.0 | 1.5 |
| Drop 3 | 65.8 | 31.8 | 2.4 |

-continued

Shatter Test (resistance to dropping) (% cumulative) (B.S. 1016, Part 13)

| | Survival (+40 mm) | Medium debris | −5 mm debris |
|---|---|---|---|
| Drop 4 | 60.7 | 35.5 | 3.8 |

The process of the present invention takes advantage of the lignosulfonate binder as the sulfur source for the oxidation and hydrolysis reactions. In other words, the process of the present invention uses a process step which was previously a problem and that step becomes a process advantage enabling the producton of high quality briquettes while reducing the environmental problems related to atmospheric discharge.

Although this invention has been described in relation to specific embodiments, modifications can be made by one skilled in the art without departing from the reasonable scope thereof.

What is claimed is:

1. A process for producing smokeless, cured fuel briquettes comprising the steps of:

(a) forming green briquettes from a particulate carbonaceous material and a lignosulfonate binder; and (b) curing said green briquettes in an oven in the presence of circulating gases containing a high percentage of oxygen and superheated steam, wherein the sulfur derived from said lignosulfonate binder is oxidized and hydrolyzed exothermally at the curing temperature forming sulfuric acid which is dissociated endothermally in case of a temperature rise above a threshold thereby promoting thermal balance within the curing zone, any remaining small excess amount of heat is removed in the circulating gases.

2. The process according to the claim 1 wherein the curing of said green briquettes is carried out in said oven at a briquette internal temperature of about 210° C. to 335° C.

3. The process according to claim 1 wherein the circulating gases and the superheated steam have air added thereto and are obtained by recycling the off gases from the curing oven via a fluidized bed combustion unit.

4. The process according to claim 3 wherein the fluidized bed combustion unit removes the sulfur oxides which are present in said off gases.

5. The process according to claim 1 wherein said oven is provided with a means to supply an oxygen-containing gas.

6. The process according to claim 1 wherein moisture containing off gases from said oven are introduced into a coal-fired fluidized bed combustion unit.

7. The process according to claim 6 wherein sulfur oxides are removed from said off gases in said combustion unit.

8. The process according to claim 7 wherein superheated steam is produced in said combustion unit from the moisture present in said off gases and then said off gases containing said superheated steam is recycled to said oven.

9. The process according to claim 1 wherein said circulating gases contain at least 14 vol.% oxygen.

10. The process according to claim 9 wherein said circulating gases contain between about 17 and 20 vol.% oxygen.

11. The process according to claim 1 wherein said circulating gases contain between about 12% and 20% by weight superheated steam.

12. A process for producing smokeless, cured fuel briquettes comprising the steps of:

(a) forming green briquettes from a particulate carbonaceous material and a lignosulfonate binder;

(b) preheating said green briquettes by progressively increasing the temperature of said green briquettes up to about the oxidation temperature while evaporating the residual moisture;

(c) curing the briquettes from step (b) in an oven in the presence of circulating gases containing superheated steam and at least 17% oxygen, wherein the sulfur derived from said lignosulfonate binder is oxidized and hydrolyzed exothermally at the curing temperature forming sulfuric acid which is dissociated endothermally in case of a temperature rise above a threshold thereby promoting thermal balance within the curing zone, any remainig small excess amount of heat being removed by injecting supplementary air and removing the excess heat in the circulating gases; and (d) precooling said briquettes from step (c) in a precooler stage then cooling the briquettes down to below about 100° C.

13. The process according to claim 12 wherein said green briquettes are formed by the process comprising:

(1) mixing, at an elevated temperature, crushed anthracite duff and ammonium lignosulfonate binder;

(2) removing excess water from the mixed material of (1); and (3) pressing the material in a press.

14. The process according to claim 13 wherein the material, prior to being pressed, has a water content that does not exceed 8% by weight.

15. A composition comprising smokeless, cured fuel briquettes produced according to the process of claim 2.

16. A composition comprising smokeless, cured fuel briquettes produced according to the process comprising the steps of:

(a) forming green briquettes from a particulate carbonaceous material and a lignosulfonate binder; and (b) curing said green briquettes in an oven in the presence of circulating gases containing a high percentage of oxygen and superheated steam, wherein the sulfur derived from said lignosulfonate binder is oxidized and hydrolyzed exothermally at the curing temperature forming sulfuric acid which is dissociated endothermally in case of a temperature rise above a threshold thereby promoting thermal balance within the curing zone, any remaining small excess amount of heat is removed in the circulating gases.

17. A process for producing smokeless, cured fuel briquettes comprising the steps of:

(a) forming green briquettes from a particulate carbonaceous material and a lignosulfonate binder; and curing said green briquettes in an oven in the presence of circulating gases containing a high percentage of oxygen and superheated steam, wherein the sulfur derived from said lignosulfonate binder is oxidized and hydrolyzed exothermally at the curing temperature forming sulfuric acid which is dissociated endothermally in case of a temperature rise above a threshold thereby promoting thermal balance within the curing zone, wherein excess heat is removed in the circulating gases.

18. The process according to claim 17 wherein the curing of said green briquettes is carried out in said oven at a briquette internal temperature of about 210° C. to 335° C.

19. The process according to claim 17 wherein the circulating gases and the superheated steam have air added thereto and are obtained by recycling the off gases from the curing oven via a fluidized bed combustion unit.

20. The process according to claim 17 wherein said circulating gases contain at least 14 vol.% oxygen.

* * * * *